US005792010A

United States Patent [19]

Allen et al.

[11] Patent Number: 5,792,010

[45] Date of Patent: Aug. 11, 1998

[54] BASKETBALL NET CLIP FOR BREAKAWAY NET ATTACHMENT SYSTEM

[75] Inventors: David A. Allen, Oconomowoc; Ronald A. White, N. Prarie; Joseph K. Bohrman, Eagle, all of Wis.; James N. Fitzsimmons, Wapakaneta, Ohio

[73] Assignee: Huffy Corporation, Miamisburg, Ohio

[21] Appl. No.: 640,127

[22] Filed: Apr. 30, 1996

Related U.S. Application Data

[63] Continuation-in-part of Ser. No. 275,954, Jul. 15, 1994, Pat. No. 5,524,883.

[51] Int. Cl.[6] ..... A63B 63/08

[52] U.S. Cl. ..... 473/485; 24/563; 248/47.2

[58] Field of Search ..... 473/485, 486, 473/489; 24/563, 115 F, 115 K; 248/74.2, 74.1, 548

[56] References Cited

U.S. PATENT DOCUMENTS

| | | | |
|---|---|---|---|
| 179,476 | 7/1876 | Hearttagen | 24/563 X |
| D. 238,284 | 12/1975 | Toedter | 273/1.5 X |
| 352,325 | 11/1886 | Jensen et al. | 24/563 |
| 1,478,896 | 12/1923 | Ferency | 24/563 X |
| 1,491,286 | 4/1924 | Calhoun | 24/563 X |
| 1,585,840 | 5/1926 | Fahnstock | 248/74.2 X |
| 1,764,950 | 6/1930 | Griner | 24/563 X |
| 2,199,609 | 5/1940 | Bennett | 273/1.5 |
| 2,489,174 | 11/1949 | Cunningham | 273/1.5 |

(List continued on next page.)

FOREIGN PATENT DOCUMENTS

| | | | |
|---|---|---|---|
| 0329893 | 8/1989 | European Pat. Off. . | |
| 2908120 | 9/1980 | Germany | 248/74.2 |
| 816709 | 7/1959 | United Kingdom | 248/74.2 |
| 894867 | 4/1962 | United Kingdom | 248/74.2 |
| 1214739 | 12/1970 | United Kingdom | 273/1.5 R |
| 1338325 | 11/1973 | United Kingdom | 248/74.2 |
| 1438758 | 6/1976 | United Kingdom | 248/74.2 |
| 2005758 | 4/1979 | United Kingdom | 248/74.2 |
| 1553077 | 9/1979 | United Kingdom | 273/1.5 R |

OTHER PUBLICATIONS

Huffy Sports Parts List and Assembly Instruction Sheet, Oct. 5, 1993, and sample net clip.

Brochure, "OBO stud welding/The better solution," OBO Bettermann (Bettermann of America, Inc., Pittsburgh, PA), 11 pages.

Murray, C.J. (ed.), "Plastic Net Clips Make Basketball Safer," *Design News*, May 8, 1995, p. 73.

EPO Search Report EP 95 30 4948, Nov. 7, 1995.

*Primary Examiner*—William H. Grieb

*Attorney, Agent, or Firm*—Howrey & Simon; Michael J. Bell

[57] ABSTRACT

A basketball net clip for a breakaway net attachment system that detachably mounts a basketball net to the rim of a basketball goal at predetermined locations along the rim. The net clips are resilient and include a base portion attachable to the rim and a retainer portion for detachably retaining the net in association with the rim. The rim preferably includes a plurality of studs located along an undersurface thereof for engaging within apertures formed in the clips whereby the clips are retained in engagement with the rim. In one embodiment, the clips are provided with fingers for retaining the net wherein the fingers will release the net in response to a predetermined force being applied to the net. In a further embodiment, the clip is adapted to be pulled off of the rim when a predetermined force is applied to the net.

23 Claims, 13 Drawing Sheets

U.S. PATENT DOCUMENTS

| | | | |
|---|---|---|---|
| 2,579,312 | 12/1951 | Garvey | 273/1.5 |
| 2,884,249 | 4/1959 | Cunningham | 273/1.5 X |
| 3,194,555 | 7/1965 | Humphrey | 273/1.5 |
| 3,216,685 | 11/1965 | Raymond | 248/74.2 |
| 3,252,677 | 5/1966 | Raymond | 248/74.2 X |
| 3,262,662 | 7/1966 | Gastaldi | 248/74.2 X |
| 3,348,272 | 10/1967 | Germani | 24/563 |
| 3,582,032 | 6/1971 | Placek | 248/548 |
| 4,082,269 | 4/1978 | Hill | 273/1.5 R |
| 4,241,916 | 12/1980 | Palm | 273/1.5 R |
| 4,353,548 | 10/1982 | Mahoney | 273/1.5 R |
| 4,358,080 | 11/1982 | Wolker | 248/74.2 X |
| 4,802,646 | 2/1989 | Cattani | 248/74.2 X |
| 4,834,368 | 5/1989 | Qualley | 273/1.5 R |
| 4,903,964 | 2/1990 | Anderson | 273/1.5 R |
| 4,905,995 | 3/1990 | Apo | 273/1.5 R |
| 4,917,340 | 4/1990 | Juemann et al. | 248/74.2 |
| 4,932,626 | 6/1990 | Guillot | 248/548 |
| 5,098,091 | 3/1992 | McGivern | 273/1.5 R |
| 5,123,642 | 6/1992 | Stokes | 273/1.5 R |
| 5,230,489 | 7/1993 | White et al. | 248/74.2 |
| 5,301,939 | 4/1994 | Ellsworth | 273/1.5 R |
| 5,338,023 | 8/1994 | Stovall | 273/1.5 R |
| 5,360,208 | 11/1994 | Fang | 273/1.5 R |
| 5,381,588 | 1/1995 | Nelson | 24/563 X |
| 5,524,883 | 6/1996 | Allen et al. | 473/485 |

BASKETBALL NET CLIP FOR BREAKAWAY NET ATTACHMENT SYSTEM

BACKGROUND OF THE INVENTION

This application is a continuation-in-part of allowed application Ser. No. 08/275,954, filed Jul. 15, 1994, now U.S. Pat. No. 5,524,883.

The invention relates to a system for detachably retaining a net on a basketball goal rim and, more particularly, to a basketball net clip for detachably retaining a net on a basketball goal rim whereby the net may be detached from the rim upon application of a predetermined force.

Basketball goal nets are typically retained on the rim of a goal by attaching looped end portions of the net to hooked portions welded to the rim of the goal. By passing the looped portions of the net over the welded rams on the rim, the net is substantially rigidly or non-detachably retained on the rim during use of the goal, for example during a game of basketball.

Under certain circumstances it is desirable to permit the net to detach from the rim of the goal whereby a force in excess of that applied during normal play will not be conveyed through or resisted by the connection point between the net and the rim. In other words, in many instances it is desirable for the net to be capable of separating from the rim, such as when a player engages and produces a pulling force on the net, while also ensuring that the net remains engaged with the rim during the normal course of play.

In one known net attachment system, plastic ties are used to wrap around the rim and looped end portions of the net whereby the net is retained on the rim of the goal. The ends of each of the plastic ties are connected to each other and will separate from each other when a large force is applied to the net, thereby permitting the net to separate from the rim of the goal. However, such a system does not position the attachment points for the net at predetermined locations such that a uniform positioning of the attachment points along the rim is not assured. Further, when the net becomes detached from the rim the connecting ties will be freed from both the net and the rim such that they may be lost, thereby hindering reattachment of the net to the rim.

Accordingly, there is a need for a basketball goal net attachment system whereby the net may be attached to predetermined locations along the rim of a basketball goal, and which further ensures that the components of the attachment system remain associated with the system during detachment of the net from the rim.

SUMMARY OF THE INVENTION

In one aspect of the invention, a system is provided for holding a net on a basketball goal rim wherein the system generally includes a clip which is attachable to the rim, the clip including a retainer portion for retaining a portion of the net on the rim. In addition, the clip is formed with a release mechanism for releasing the net from the rim in response to the application of a predetermined force on the net. In one aspect of the invention, the retainer portion comprises elongated finger members for retaining the member on the clip. The finger members may be in the form of hook shaped elements located along alternating sides of the clip in facing relationship to each other whereby the net is retained in the clip. Alternatively, the retainer portion may comprise opposing finger members wherein one finger member includes a hook end and the opposing finger member includes a detent end for engaging the hook end whereby a passage is defined for retaining the net in engagement with the clip.

Upon application of a predetermined force, the finger members will flex and separate to permit the portion of the net engaged within the passage formed between the fingers to pass out of the passage, resulting in separation of the net from the rim.

In a further aspect of the invention, the rim is provided with studs rigidly attached at regular intervals along a lower portion of the rim. The studs include an enlarged head portion for engaging within an aperture formed in a base portion of the clip. The aperture may be in the form of either an elongated slot for sliding the clip into place on the stud, or in the form of a circular aperture configured to permit the clip to be pushed toward the rim causing the head of the stud to pass through the aperture.

The base of the clip is generally designed to ensure that the clip remains engaged with the rim during separation of the net from the above-described finger members. In this manner, reattachment of the net to the rim is facilitated in that the clip is retained with the system.

In a further embodiment of the invention, the retainer portion of the system comprises means defining an aperture for receiving a doubled-over looped portion of the net. The net is retained on the clip by causing the doubled-over looped end of the net to pass through the aperture and extend around the clip. In addition, the clip includes an aperture for receiving a stud rigidly mounted to the rim of the basketball goal wherein the stud includes an enlarged head. The means defining the aperture for receiving the stud is sufficiently resilient to permit the aperture to expand for permitting the clip to disengage from the rim upon application of a predetermined force. The clip is designed to remain engaged with the net such that the net may be readily reattached to the rim.

Therefore, it is an object of the invention to provide a net retention system for a basketball goal whereby the net is detachably retained on the rim of the goal.

It is a further object of the invention to provide such a net retention system including a clip for retaining a portion of the net on the rim.

It is yet a further object of the invention to provide such a system wherein the clip is attachable to the rim of a basketball goal and wherein the net is disengagable from the clip in response to a predetermined force applied to the net.

It is another object of the invention to provide a net retention system including a clip wherein the clip is detachable from the rim of a basketball goal upon application of a predetermined force.

Other objects and advantages of the invention will be apparent from the following description, the accompanying drawings and the appended claims.

DETAILED DESCRIPTION OF THE PREFERRED EMBODIMENTS

Figure 1:
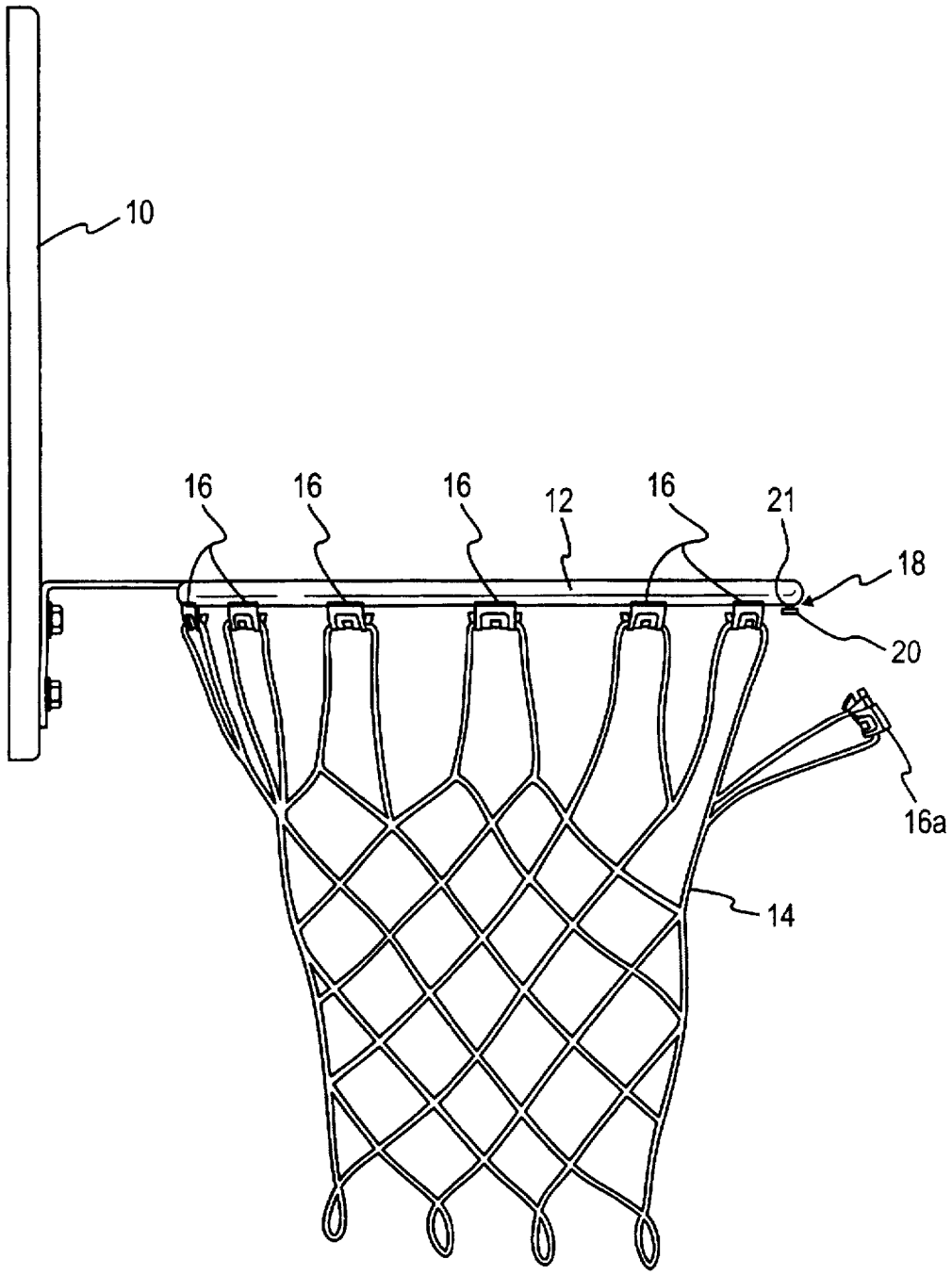
FIG. 1 is a side elevational view of a basketball goal incorporating the net retention system of the invention.

Referring to FIG. 1, the net retention system of the invention is intended to be used with a conventional basketball goal system including a backboard 10 supporting a rim 12. A net 14 is attached to the rim by a plurality of clips 16, each of the clips 16 holding a looped mounting portion of the net 14. One of the clips 16a is shown detached from the rim 12 to reveal a mounting portion for the clip in the form of a stud 18 wherein the stud includes a shaft portion 21 and an enlarged head 20 and is rigidly mounted to the rim 12 through a welded connection or the like. One particularly advantageous way of connecting the studs to the rim is the drawn arc stud welding process described in commonly assigned, copending application Ser. No. 08/594,519 of David A. Allen, entitled Basketball Goal Rim for Breakaway Net Attachment System and Method of Making Same, the disclosure of which is incorporated by reference herein. Of course, other suitable methods may be employed for rigidly connecting the studs to the rim as will be readily appreciated by those skilled in the art. Twelve of the studs 18 are located along the lower edge of the rim 12 in substantially uniformly spaced relation to each other whereby a plurality of predetermined mounting locations for the clips 16 are defined.

Referring to FIGS. 2–5, the clip 16 includes a base portion 22 and a retainer portion defined by a plurality of elongated finger members 24, 26, 28, 30 wherein the finger members 24, 30 extend from a side portion 32 of the base portion 22 and the finger members 26, 28 extend from an opposing side portion 34 of the base portion 22. Further, the finger members 26, 28 are connected to each other through a bridge portion 36.

It should be noted that the finger members 24, 26, 28, 30 are formed as hooked shaped members defining a passage 38 through the clip 16 in spaced relation to the rim 12 for receiving a portion of the net 14 wherein the net 14 may be positioned within the passage 38 by threading it over the ends of the finger members 24, 26, 28, 30.

Figure 2:
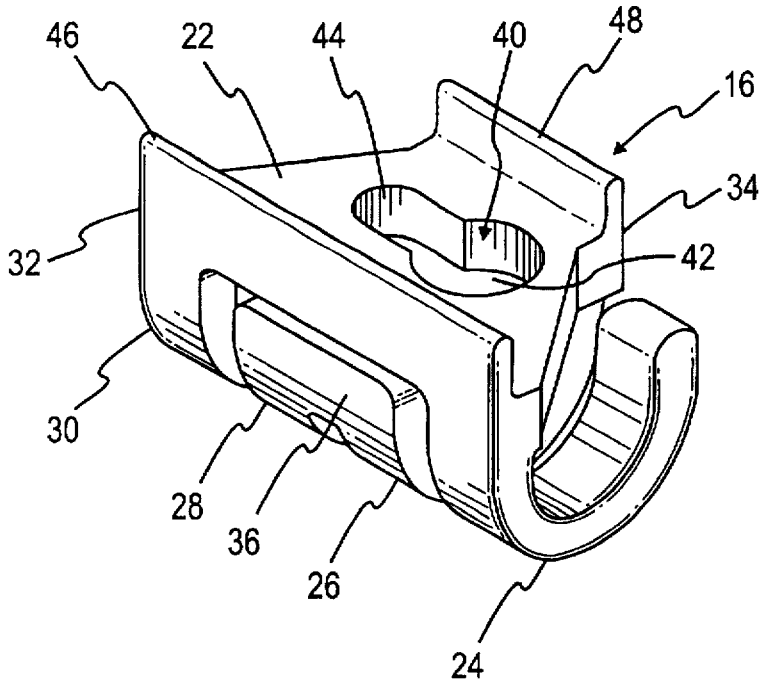
FIG. 2 is a perspective view of a clip for use in the system of the invention.
Figure 3:
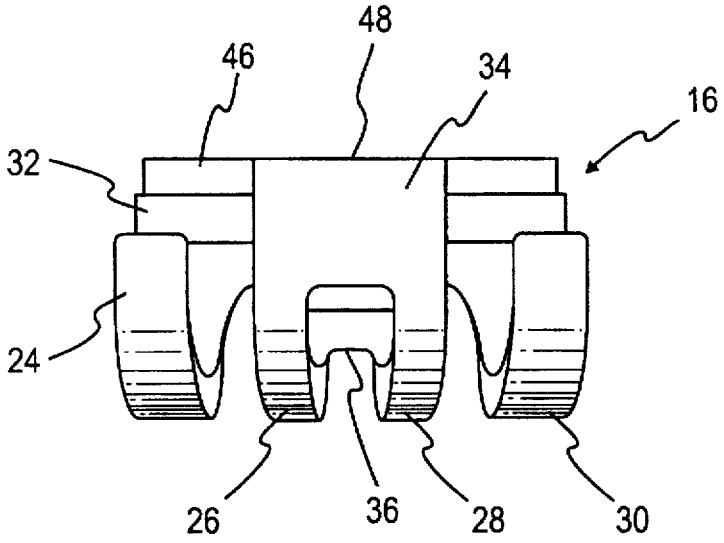
FIG. 3 is a side elevational view of the clip of FIG. 2.
Figure 4:
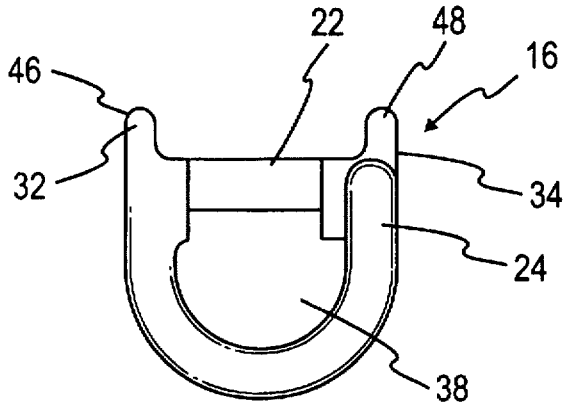
FIG. 4 is an end view of the clip of FIG. 2.
Figure 5:
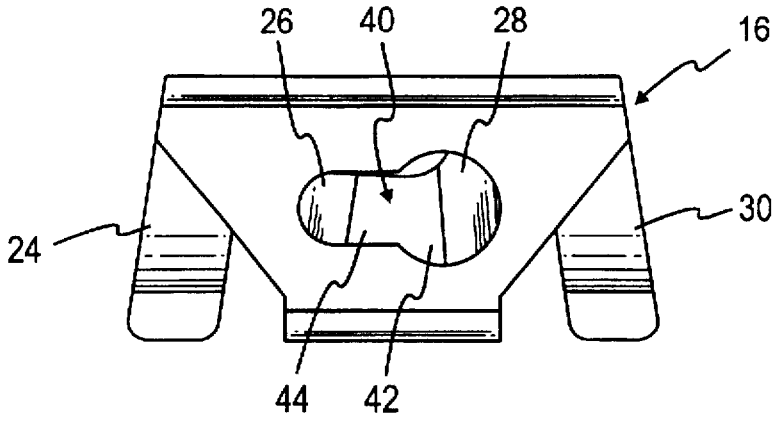
FIG. 5 is a top plan view of the clip of FIG. 2.

As seen in FIGS. 2 and 5, an engaging portion for engaging the stud 18 is defined on the base portion 22 and comprises means defining an aperture 40 through the base portion 22. The aperture 40 is in the form of a keyhole slot having an enlarged portion 42 and a neck portion 44. The enlarged portion 42 is sized to receive the enlarged head 20 of the stud 18 and the neck portion 44 is sized smaller than the head 20 of the stud 18 and is adapted to receive the shaft portion 21. Thus, the clip 16 will be held rigidly in place on the rim 12 when the stud 18 is positioned within the aperture 40 and is slid into alignment with the neck portion 44 of the aperture 40.

Figure 6:
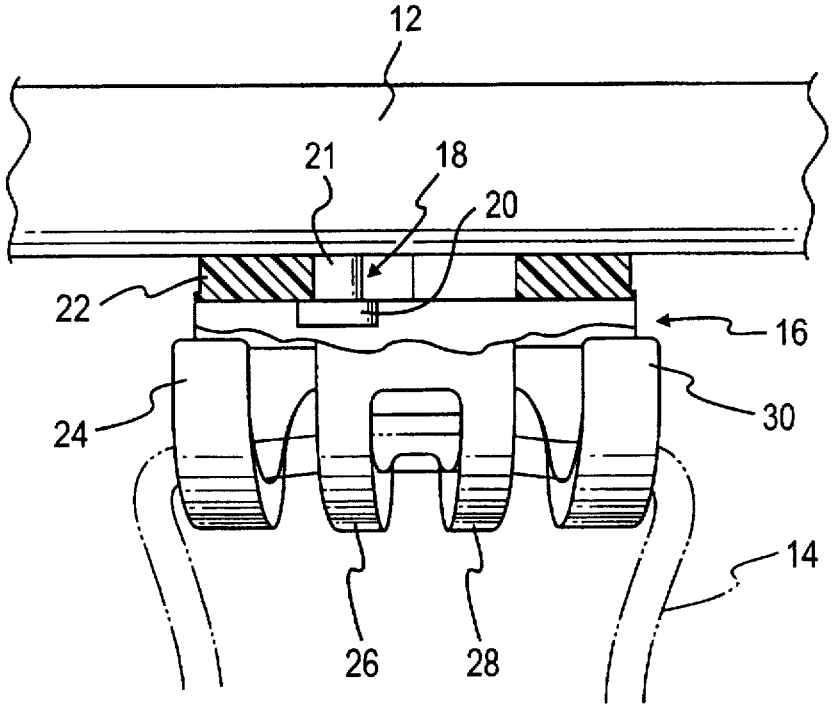
FIG. 6 is a partially cut away view showing the clip of FIG. 2 mounted to the rim of a basketball goal.
Figure 7:
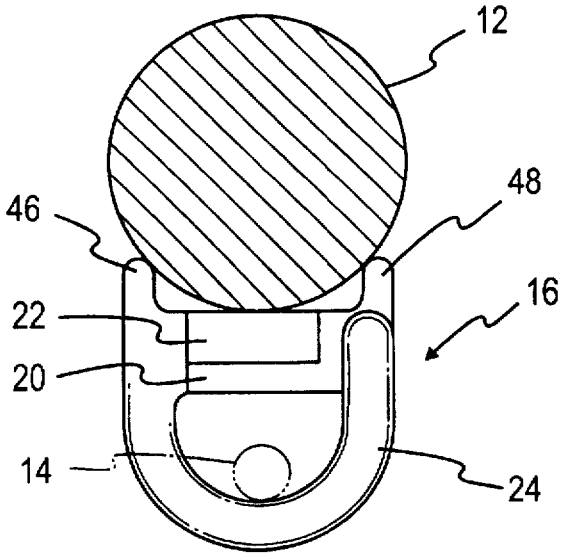
FIG. 7 is an end view of the clip of FIG. 2 mounted to the rim of a basketball goal.
Figure 8:
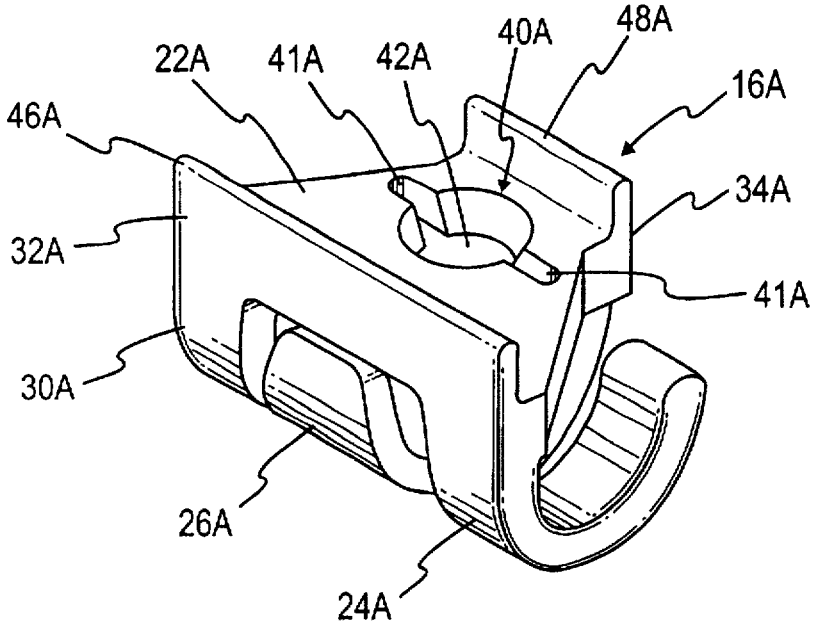
FIG. 8 is a perspective view of a second embodiment of the clip.
Figure 9:
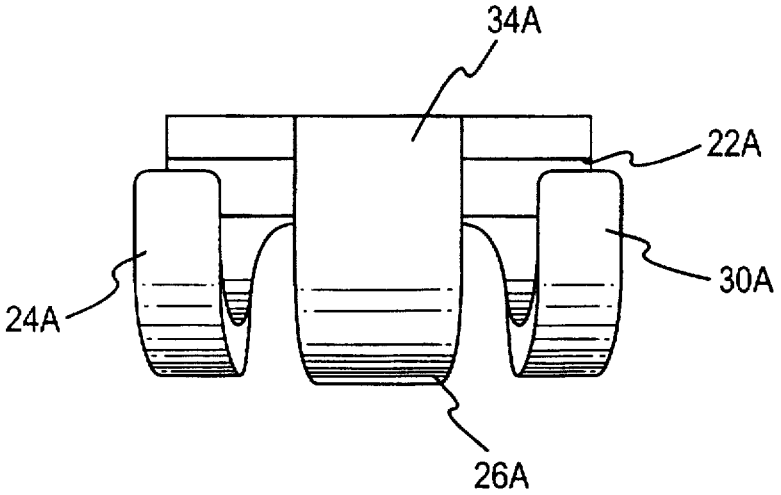
FIG. 9 is a side elevational view of the clip of FIG. 8.

Referring to FIGS. 6 and 7, the clip 16 is shown mounted to a portion of the rim 12 wherein a portion of the net 14 passes through the passage 38 defined by the finger members 24, 26, 28, 30. It should be noted that the opposing side portions 32 and 34 of the base portion 22 include upwardly extending legs 46 and 48, respectively, for engaging the rim 12 and thereby providing a stable base for the clip 16 preventing rocking and rotational movement of the clip relative to the rim 12.

In addition, it should be noted that the clip 16 is preferably formed of a resilient material, such as nylon or the equivalent, whereby the finger members further comprise a release mechanism for releasing the net 14 from the rim 12 in response to application of a predetermined force on the net 14. Specifically, the finger members are capable of moving or flexing downwardly and outwardly to permit the net 14 to pass out of the passage 38 when a predetermined force is applied on the net.

Further, as seen in FIG. 7, the clip 16 is configured such that it is smaller than the diameter of the rim 12. Thus, the clip 16 is substantially located below the rim 12 such that the top and side portions of the rim 12 are substantially unobstructed by the clip 16. The configuration for the clip 16 minimizes the possibility of a ball contacting the clip 16 during use of the net attachment system.

Referring to FIGS. 8–11, a second embodiment of the clip for the invention is illustrated and is identified as 16A. The clip 16A is substantially similar to the clip 16 of the first embodiment and includes a base portion 22A having opposing sides 32A, 34A. Three finger members 24A, 26A, 30A are provided extending in alternating manner from the opposing sides 32A and 34A to define a net receiving passage 38A. In addition, a pair of legs 46A and 48A extend upwardly on the base portion 22A for engagement with the rim 12.

Figure 10:
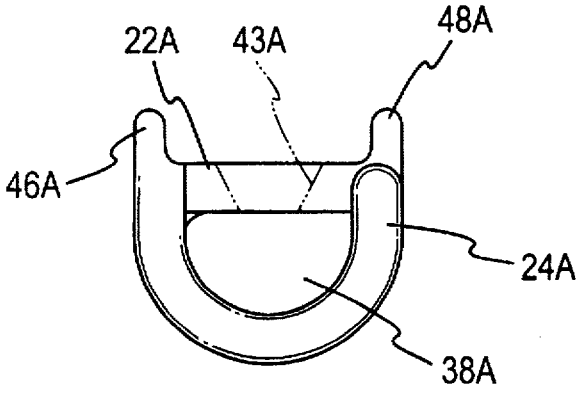
FIG. 10 is an end view of the clip of FIG. 8.
Figure 11:
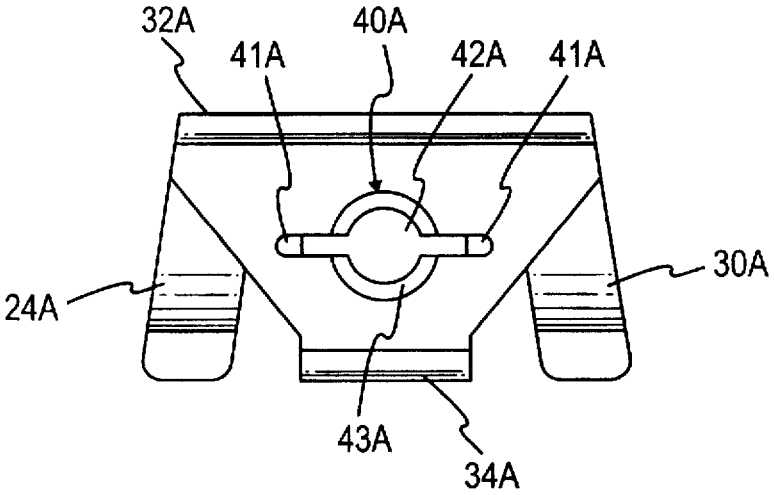
FIG. 11 is a top plan view of the clip of FIG. 8.

The clip 16A is provided with an aperture 40A including means defining a substantially circular opening 42A for receiving the stud 18. As seen in FIG. 10, the means defining the opening 42A includes sloped or tapered walls 43A to facilitate insertion of the head portion 20 of the stud 18 through the base portion 22A. In addition, narrow slotted areas 41A are provided extending radially from the open area 42A to further facilitate opening of the area 42A upon insertion of the clip past the head portion 20. Thus, the clip 16A is mounted to the rim 12 by moving the base portion 22A toward the rim 12, causing the stud 18 to pass through the aperture 40A. Further, although only two slots 41A are illustrated, it should be understood that any number of the slots 41A may be provided to facilitate mounting of the clip 16A to the rim 12.

The clip 16A operates in a manner similar to that described for the clip 16 of the first embodiment in that the finger members 24A, 26A, 30A will retain a portion of the net 14 on the rim 12 during the normal course of play, and are formed of a resilient material such that they will release the net in response to application of a predetermined force on the net 14. In addition, the area of engagement between the aperture 40A and the stud 18 is configured such that the clip 16A will be retained on the rim 12 during release of the net 14.

Figure 12:
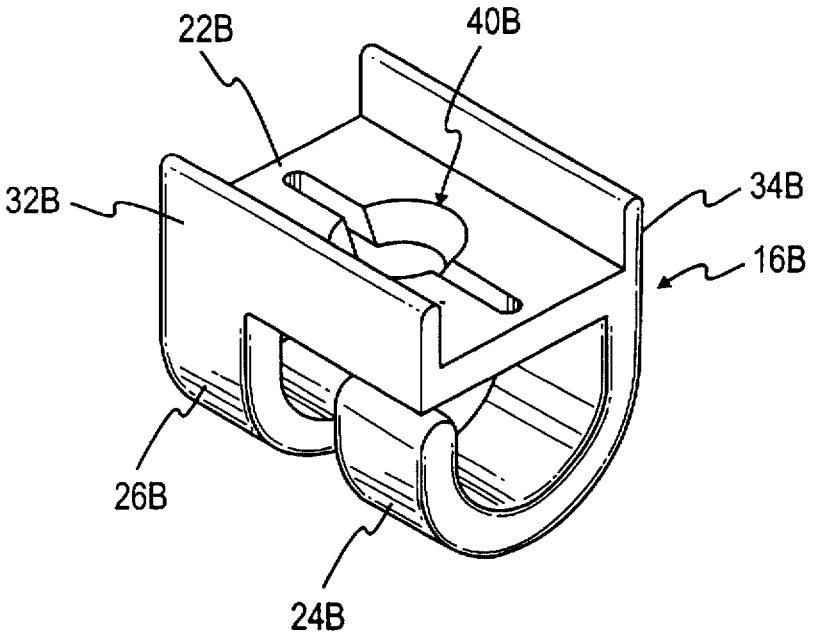
FIG. 12 is a perspective view of a third embodiment of the clip.

Referring to FIG. 12, a third embodiment of the clip is illustrated and designated as 16B. The clip 16B is substantially similar to the clip 16A of the second embodiment with the exception that only two finger members 24B, 26B are provided. The finger members 24B, 26B extend from alternate sides 32B, 34B of a base portion 22B. Further, an aperture 40B similar to aperture 40A is provided for engagement with a stud 20 on the rim 12.

It should be noted that by providing different numbers of finger members, as well as by varying the width or thickness of the finger members, the amount of force required to detach the net from the clip member may be selectively varied.

Figure 13:
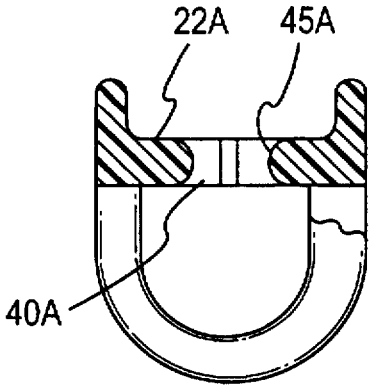
FIG. 13 is an end view of the clip of FIG. 9 partially cut away to show an alternative configuration for an aperture defining an engaging portion for a clip.

Referring to FIG. 13, an alternative configuration for the aperture 40A of the clip 16A is illustrated wherein the tapered walls 43A of the aperture 40A have been replaced with radiused walls 45A. By providing the radiused walls 45A, the clip 16A is provided with the capability of being pulled off of the stud 18 upon application of a predetermined force. In addition, the enlarged head portion 20 of the stud 18 may be designed with a taper in order to facilitate movement of the base portion 22A out of engagement with the stud 18. Thus, the clip 16A may be configured with a dual release mechanism in that, upon application of a predetermined force, either the net will separate from the finger members 24A, 26A, 30A, or the entire clip 16A will separate from the rim 12.

It should be noted that the radiused aperture illustrated in FIG. 13 may also be incorporated into the embodiment of the clip illustrated in FIG. 12 in order to provide the clip 16B with a dual release mechanism.

Figure 14:
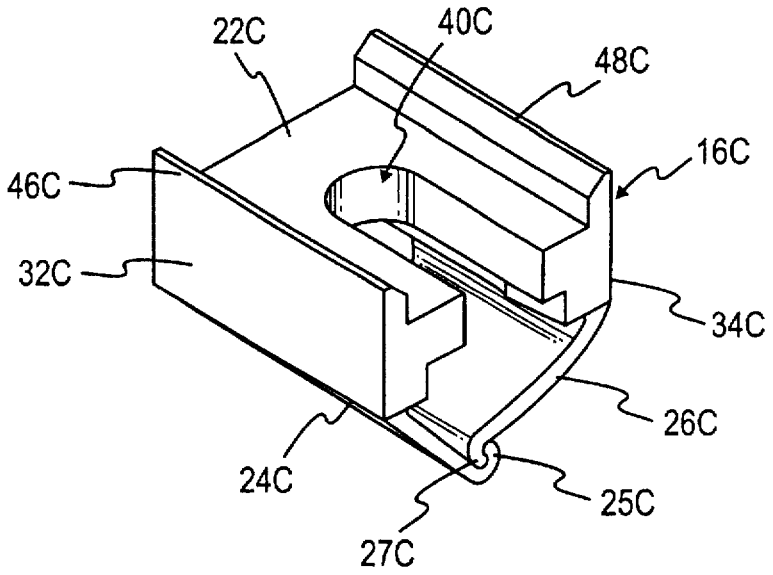
FIG. 14 is a perspective view of a fourth embodiment of the clip.
Figure 15:
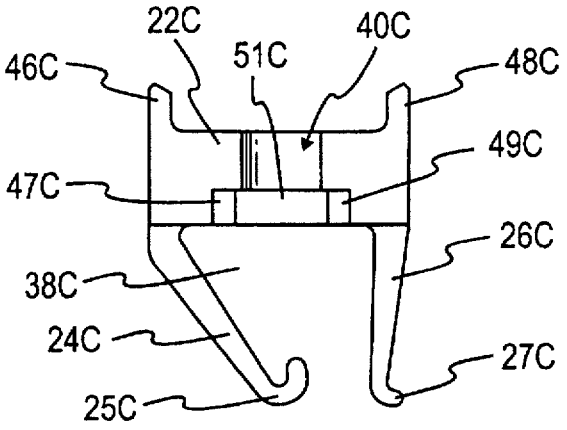
FIG. 15 is an end view of the clip of FIG. 14.
Figure 16:
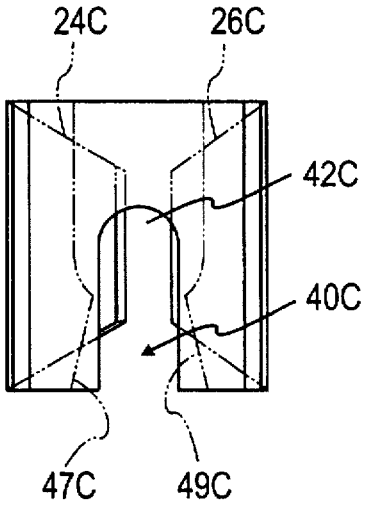
FIG. 16 is a top plan view of the clip of FIG. 14.

Referring to FIGS. 14–16, a fourth embodiment of the clip is illustrated and is designated as 16C. The clip 16C includes a base portion 22C having opposing side portions 32C , 34C supporting opposing finger members 24C and 26C respectively. The finger member 24C includes a hook end 25C and the finger member 26C includes a detent end 27C for engaging with the hook end 25C. Referring to FIG. 15, the finger members 24C and 26C are shown in a position prior to retention of the net 14 in the clip 16C. After insertion of a portion of the net 14 into the area 38C, the finger member 26C is moved toward the finger member 24C whereby the detent end 27C engages with the hook end 25C, as shown in FIG. 14.

As seen in FIGS. 14 and 16, the base portion 22C is provided with an aperture 40C in the form of an elongated slot to receive the stud 18. The slot 40C includes a lower area 51C for cooperating with the sides of the head portion 20 of the stud 18. The lower area 51C includes walls 47C and 49C angling inwardly from an open mouth of the slot 40C, and the walls 47C, 49C, define a restricted end area 42C of the slot 40C whereby the head 20 is retained in position on the clip 16C. Thus, the clip 16C is mounted to the rim 12 by sliding the clip 16C along a stud 18 until the enlarged head 20 of the stud 18 is located adjacent to the area 42C.

In use, the clip 16C is rigidly retained on the rim 12 and supports a portion of the net 14 within the passage 38C defined between the interengaged finger members 24C and 26C. When a predetermined force is applied against the net, the finger members 24C and 26C will flex thereby causing the detent end 27C to disengage from the hook end 25C to release the net from the clip 16C.

Figure 17:
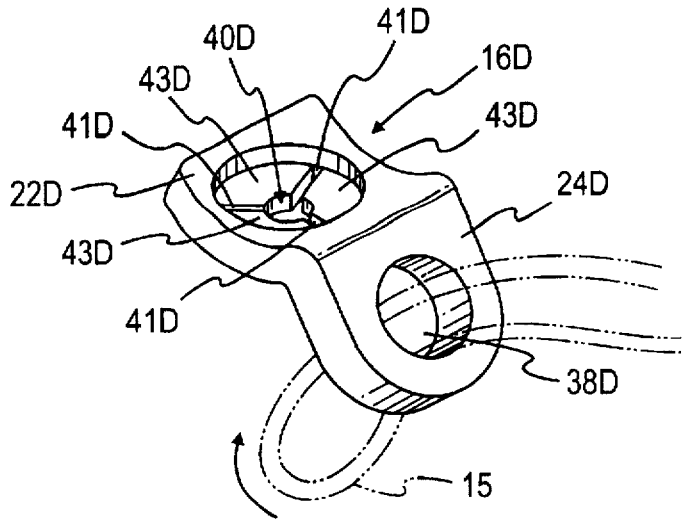
FIGS. 17–19 are perspective views of a fifth embodiment of the clip showing the steps of attaching a portion of the net to the clip.
Figure 18:
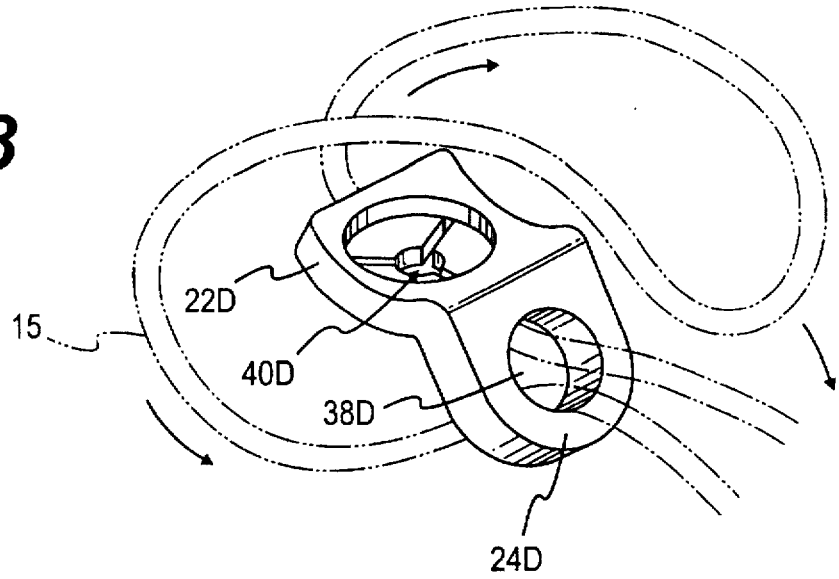
Figure 19:
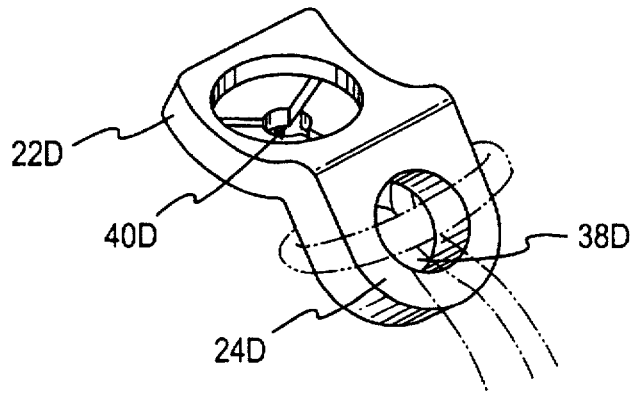

Referring to FIGS. 17–19, a fifth embodiment of the clip is illustrated and is designated 16D. The clip 16D includes a base portion 22D and retainer portion 24D. The base portion is curved to substantially match the curvature of the rim 12 and includes an engaging portion including means defining an aperture 40D and a plurality of slots 41D extending radially therefrom whereby a plurality of flexible tangs 43D are formed having end portions defining the aperture 40D. The tangs 43D flex to permit the base portion 22D to be readily attached to and detached from a stud 18 on the rim 12 upon application of a predetermined force.

The retainer portion 24D extends at an angle downwardly from the base portion 22D, and may extend substantially perpendicular to the base portion 22D. The retainer portion 24D also includes an aperture 38D for receiving a doubled-over looped portion of the net 14. The net is retained on the clip 16D by causing the doubled-over looped portion 15 to pass through the aperture 38D and extend around the retainer portion 24D of the clip 16D, as illustrated in FIGS. 17–19. Thus, upon application of a predetermined force to the net 14, the net 14 will be rigidly retained on the clip 16D and will cause the clip 16D to detach from an associated stud 18.

Figure 20:
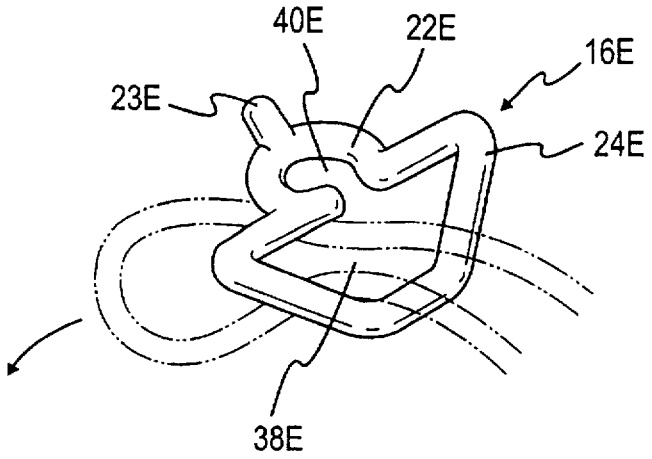
FIGS. 20–22 are perspective views of a sixth embodiment of the clip showing the steps of attaching a portion of the net to the clip.
Figure 21:
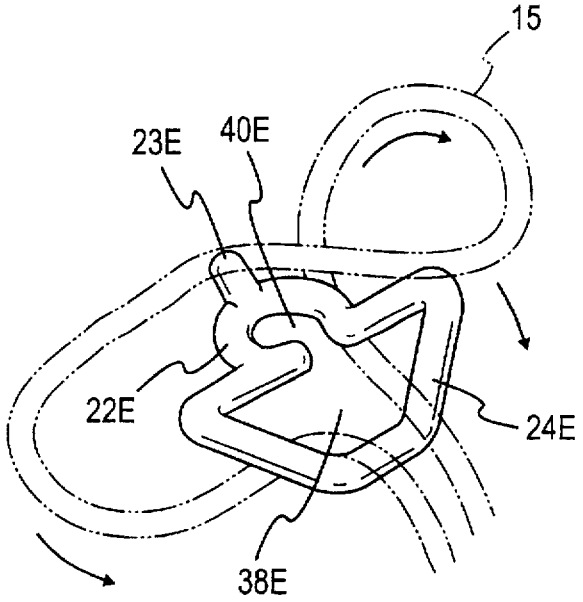
Figure 22:
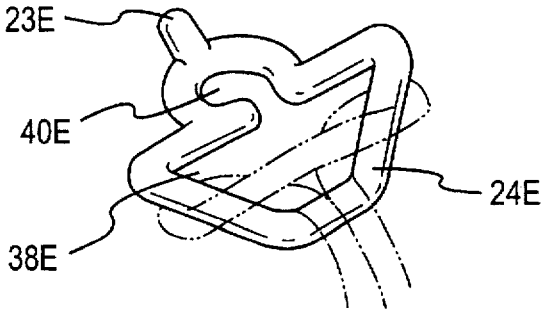
Figure 23:
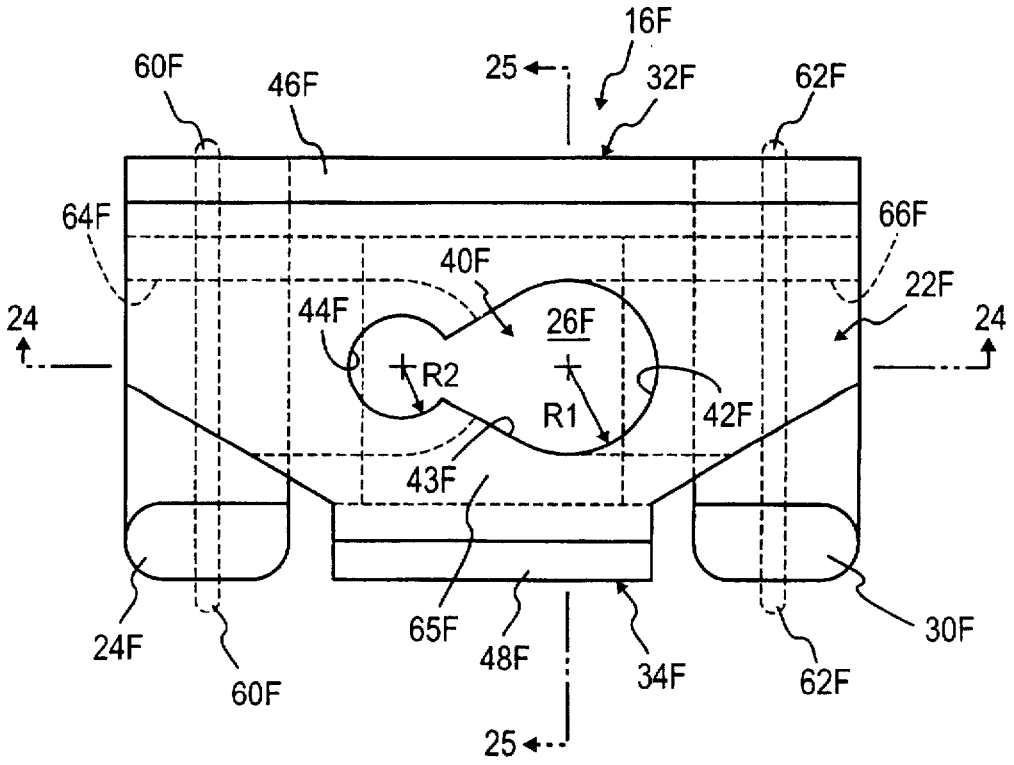
FIG. 23 is a top plan view of a seventh embodiment of the clip of the invention showing sections of the clip not visible from above phantom.
Figure 24:
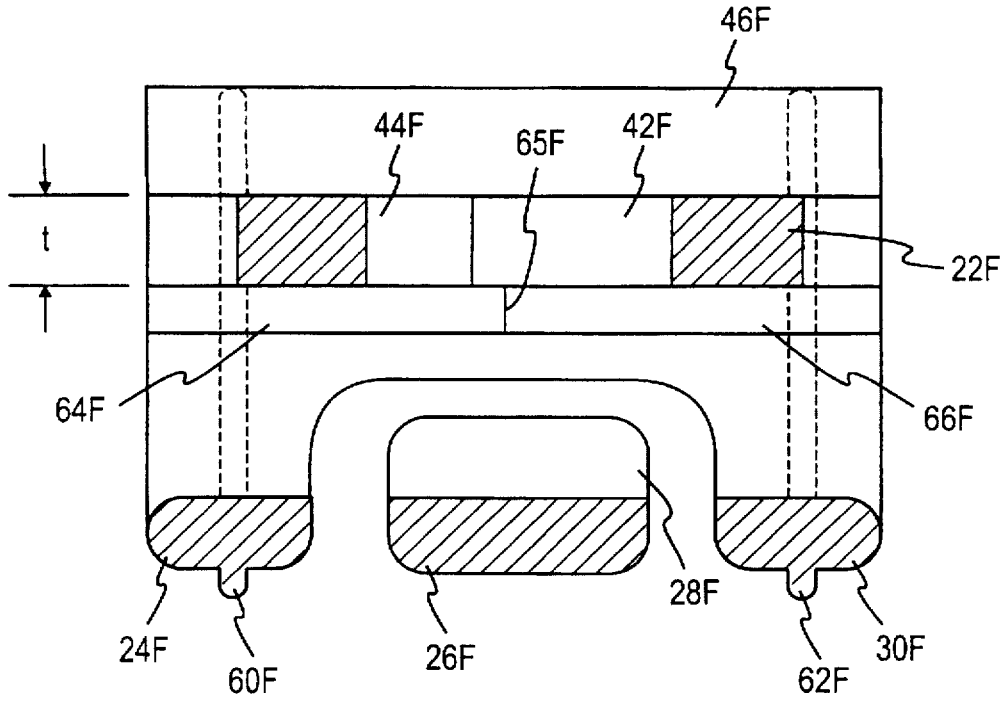
FIG. 24 is a longitudinal sectional view of the clip of FIG. 23 taken along lines 24—24 in FIG. 23.
Figure 25:
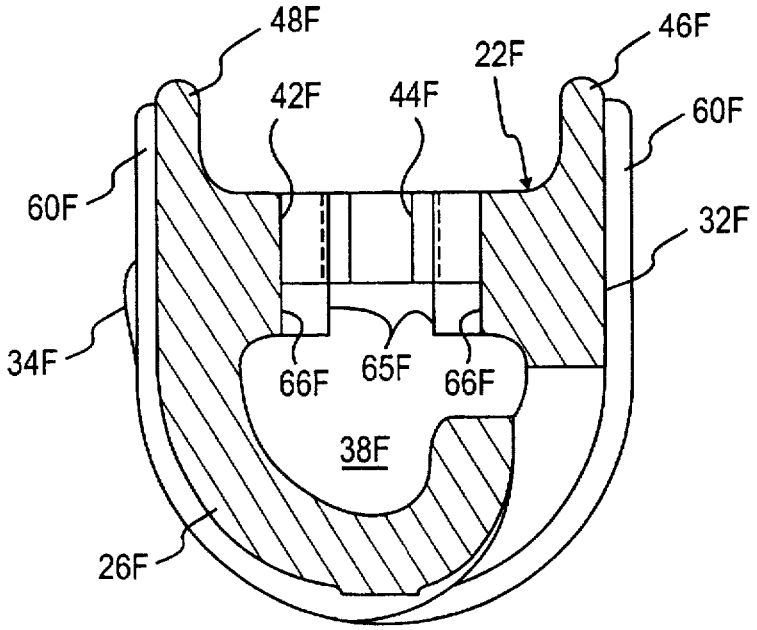
FIG. 25 is a transverse sectional view of the clip of FIG. 23 taken along lines 25—25 in FIG. 23.
Figure 26:
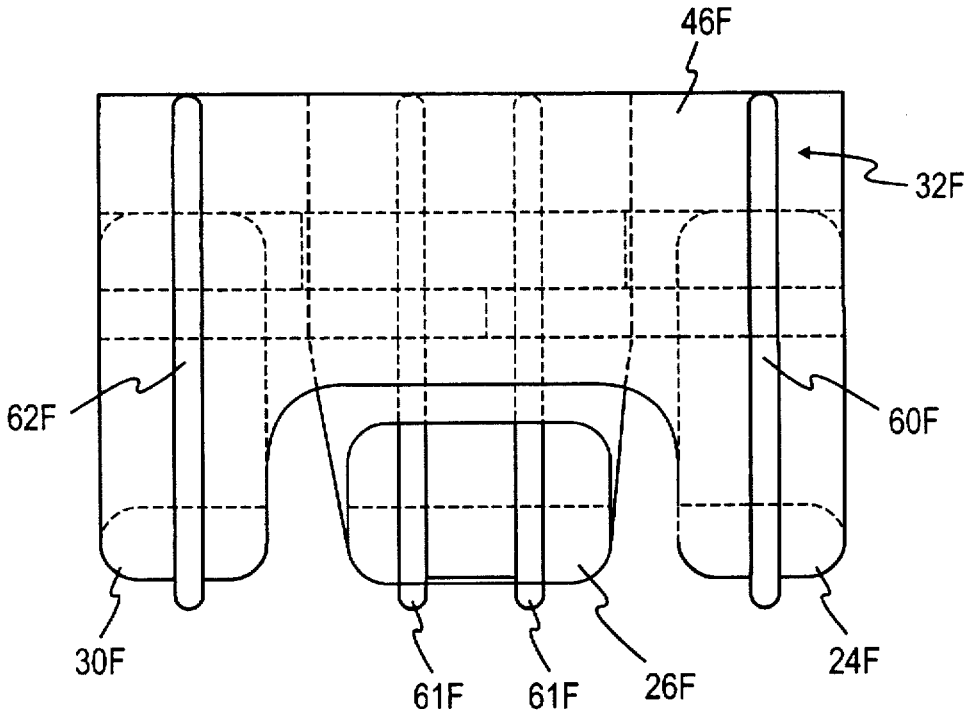
FIG. 26 is a side elevational view of one side of the clip of FIG. 23.
Figure 27:
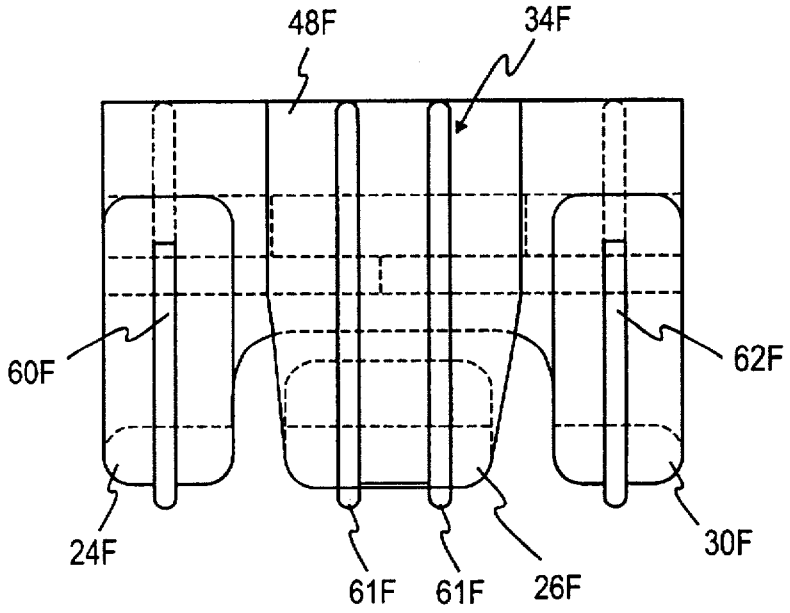
FIG. 27 is a side elevational view of the other side of the clip of FIG. 23.
Figure 28:
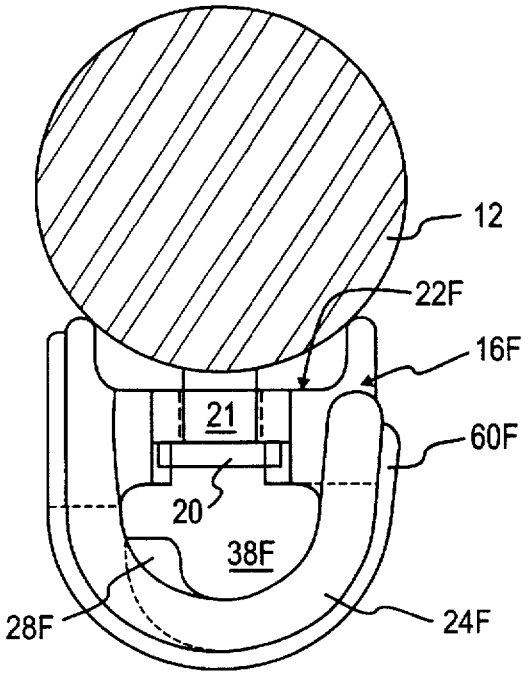
FIG. 28 is an end view of the clip of FIG. 23 mounted to the rim of a basketball goal.

Referring to FIGS. 20–22, a sixth embodiment of the clip is illustrated designated as 16E. The clip 16E includes a base portion 22E and a retainer portion 24E. The clip 16E is formed as a substantially hollow frame member wherein the base 22E is substantially circular defining a retainer portion aperture 40E for engaging a stud 18. Thus, the aperture 40E is defined by a loop of material forming the frame member and is adapted to resiliently open to permit passage of the head 20 for the stud 18 therethrough. The base 22E also includes an outwardly extending leg 23E to provide an additional support for contacting the rim 12 and stabilizing the clip 16E. Further, the retainer portion 24E defines an aperture 38E for receiving a doubled-over looped portion 15 of the net 14. The net 14 is attached to the clip 16E in a manner similar to that described above for the fifth embodiment of the clip 16D, as illustrated in FIGS. 20–22.

Referring to FIGS. 23–28, a seventh embodiment of the clip is illustrated and is designated as 16F. The clip 16F is substantially similar to the clip 16A of the second embodiment shown in FIGS. 8–11, but includes an aperture 40F in the form of a keyhole-type slot more similar to slot 40 of the first embodiment than the circular aperture 40A provided in the second embodiment. The structure and function of clip 16F is substantially similar to the clips described in the first and second embodiments. The base portion 22F of clip 16F has opposing sides 32F and 34F, with outer fingers 24F and 30F extending downwardly from side 32F while inner finger 26F extends downwardly from opposite side 34F. Finger 26F is visible through the aperture 40F shown in FIG. 23 and includes a bulbous end portion 28F best shown in FIGS. 24 and 28, which helps retain the net in passage 38F.

One or more of the finger members 24F, 26F and 30F may be provided with a rib projecting outwardly from the outer surface of the finger member and extending along the length of the finger member. In the illustrated embodiment of FIGS. 23–28, outer finger members 24F and 30F are formed with ribs 60F, 62F, respectively, which extend from the top of one of the upstanding legs 46F and 48F, to the end of the respective finger member. Inner finger 26F is shown as having two spaced ribs 61F extending from near the top of upstanding leg 48F to the end of finger member 26F. The ribs 60F, 61F and 62F serve to increase the strength and rigidity of the individual finger members and are especially useful when forming the clip from a particularly resilient material. Of course, depending upon the desired release force and the material properties employed, the ribs may be eliminated in whole or in part.

Aperture 40F is similar to the keyhole slot aperture 40 described in connection with a first embodiment, but is formed from two, generally circular portions having different radii $r_1$ and $r_2$, and which are connected together by a substantially straight transition portion. In particular, the slot 40F has an enlarged portion 42F with a radius of curvature $r_1$ and a reduced portion 44F having a smaller radius of curvature $r_2$. The enlarged portion 42F has a cross-section somewhat larger than a semi-circle, while the reduced portion 44F with the smaller radius $r_2$ subtends an arc much greater than 180 degrees. The two circular portions 42F and 44F are connected by opposed, substantially straight portions 43F. As in the first embodiment of clip 16, the enlarged portion 42F is sized to receive the enlarged head 20 of the stud and the reduced portion 44F is sized smaller than the head 20 of the stud and is adapted to receive the shaft portion 21. In addition, the underside of base portion 22F is slotted or cutout at 64F and 66F beneath the aperture 40F, as shown best in FIGS. 23 and 24. Towards the middle of the slotted portions 64F and 66F, the sides of the slot extend inwardly at 65F at a position adjacent, but just outside the opening of reduced portion 44F. This narrowed portion 65F underneath the base helps retain the shaft portion 21 of the stud 18 within the reduced portion 44F. In addition, the thickness t of the base portion 22F has been increased slightly over that shown in the first embodiment to increase the force with which the clip is held onto the rim.

In one particularly advantageous and presently preferred embodiment of the invention, the clip 16F may be formed from a commercially available blend of ultraviolet radiation (U.V.) stabilized polypropylene sold by the M. A. Hanna company of Cleveland, Ohio under the trade name XP-5989 and having the following material properties:

Tensile Strength: 2400 psi

Elongation: 4%

Flexural Modulus: 105,000 psi

Notched IZOD: 12.5 ft.-lb./in.

Of course, other materials may be used instead of this particular blend of polypropylene and different properties may be designed for instead of the particular values enumerated above without departing from the principles of the invention, as will be readily apparent to the skilled artisan.

From the above description, it should be apparent that the breakaway net attachment system of the invention is adapted to retain a net on a basketball goal rim in a manner which ensures that the net remains in place during normal play and which permits the net to be detached from the rim in response to the application of a predetermined force. In addition, it should be noted that the present system is particularly designed to permit a net to become detached upon the application of a force in the range of 25–50 lbs., when such force is applied to a single clip. Further, the system is adapted to release a net from a basketball goal rim when a force of 140 lbs. is applied to a net supported by a typical system incorporating twelve clips mounted to the rim.

It should also be apparent that the invention is designed to ensure that the clips for mounting the net are not lost when the net becomes detached in that the clips are designed to either remain attached to the rim or attached to a portion of the net upon detachment of the net from the rim, such that the system facilitates reattachment of the net to the rim.

Further, the attachment system of the invention provides a non-obtrusive means for attaching a net to a basketball goal rim in that the clips provided by the invention are substantially located below the rim. In this manner, the possibility of contact between the clips and a basketball is minimized.

While the forms of apparatus and processes herein described constitute preferred embodiments of this invention, it is to be understood that the invention is not limited to these precise forms, and that changes may be made therein without departing from the scope of the invention which is defined in the appended claims:

What is claimed is:

1. A basketball net clip for releasably retaining a net on a basketball goal rim, said clip comprising:

a base portion having an aperture defined by resilient walls adapted to mount the clip onto a basketball goal rim;

a flexible, elongated finger member defining a passage for retaining a looped portion of a net, said finger member being resilient enough to yield without breaking or permanently deforming to release a net portion retained in the passage in response to application of a predetermined, generally downwardly directed force; and means for engaging the basketball goal rim to reduce rocking or rotational movement of the clip relative to the basketball goal rim.

2. The basketball net clip of claim 1 wherein said elongated finger member comprises a plurality of individual, opposed fingers.

3. The basketball net clip of claim 2 wherein said base portion has opposing side portions, and said fingers depend downwardly from said side portions.

4. The basketball net clip of claim 3 wherein said fingers are curved and comprise two, spaced outer fingers connected to one of said opposing side portions and an inner finger connected to the other of said opposing side portions, said inner finger being disposed intermediate said outer fingers.

5. The basketball net clip of claim 4 wherein said inner finger comprises two fingers having distal ends disposed remote from said other opposing side portion, said distal ends being connected together by a bridging member.

6. The basketball net clip of claim 3 wherein said fingers comprise two curved members with one of the curved members depending downwardly from one of said opposed side portions and the other curved member depending downwardly from said other opposed side portion.

7. The basketball net clip of claim 6 wherein one of said fingers includes a hook end and an opposing finger includes a detent end for engaging said hook end whereby said passage is defined between said fingers when said hook end receives said detent end, said ends of said finger members being separable from each other upon application of said predetermined force.

8. The basketball net clip of claim 1 wherein said apeerture comprises a keyway slot having an elongated slot and an opening larger than said slot.

9. The basketball net clip of claim 1 wherein said aperture comprises an opening having inwardly sloping walls.

10. The basketball net clip of claim 9 wherein said opening is generally circular in shape.

11. The basketball net clip of claim 10 wherein said base member includes at least one slot intersecting with the walls of said circular opening.

12. The basketball net clip of claim 1 wherein said aperture comprises a generally circular opening defined by radiused walls.

13. The basketball net clip of claim 1 wherein said aperture comprises an enlarged portion and a reduced portion, said enlarged portion being larger than a complementary mounting portion of a basketball goal rim, and said reduced portion being smaller than the complementary mounting portion.

14. The basketball net clip of claim 13 wherein said enlarged portion has a first circular portion defined by a first radius of curvature and said reduced portion has a second curcular portion defined by a second radius of curvature smaller than said first radius.

15. The basketball net clip of claim 14 wherein said aperture is further defined by a section having substantially straight walls disposed between said enlarged and reduced portions.

16. The basketball net clip of claim 1 wherein said engaging means comprises a pair of spaced projections extending upwardly from said base portion.

17. The basketball net clip of claim 1 wherein said finger member includes a reinforcing portion formed integrally with said finger member.

18. The basketball net clip of claim 17 wherein said reinforcing portion comprises a rib extending outwardly from and longitudinally along said finger member.

19. The basketball net clip of claim 1 wherein said base portion and finger member are integrally formed from a resilient material having a tensile strength of approximately 2400 psi, an elongation of approximately 4%, a flexural modulus of approximately 105,000 psi, and a notched IZOD of approximately 12.5 ft-lb./in.

20. A basketball net clip for releasably retaining a net on a basketball goal rim, said clip comprising:

a base portion having a first flexible aperture adapted to detachably secure the clip onto a mounting portion defined at a predetermined location on a basketball goal rim and having an upper surface adapted to conform to the contour of a portion of the basketball goal rim to which the clip is mounted;

a retainer portion having a second aperture for receiving a doubled-over looped portion of a net prior to the base portion of the clip being secured to a mounting portion of a rim such that the doubled-over looped portion extends around the retainer portion for fixedly securing the net thereto; and wherein said flexible aperture permits the clip to be separated from a rim upon which it is mounted without breaking or permanently deforming in response to application of a predetermined force on the net, said force being operable to tighten the doubled-over looped portion around the retainer portion and thereby retain the net on the clip after separation from a rim.

21. The basketball net clip of claim 20 wherein said first flexible aperture comprises a plurality of resiliently movable tangs having end portions defining said first aperture.

22. The basketball net clip of claim 20 wherein said clip is formed as a hollow frame member and said first aperture is defined by a loop of material forming said frame member, said first aperture being adapted to receive a mounting part of a basketball goal rim.

23. The basketball net clip of claim 22 further comprising an upstanding projection connected to the loop of material defining said aperture for stabilizing the clip by abutment against a basketball goal rim to which it is mounted.

* * * * *